United States Patent [19]

Rasch, deceased et al.

[11] 4,168,557

[45] Sep. 25, 1979

[54] POOL CLEANERS

[76] Inventors: Wilhelm Rasch, deceased, late of Ulm-Donau, Fed. Rep. of Germany; by Gertrud Rasch, heiress, Bleicherwalkstrasse 12, Ulm-Donau, Fed. Rep. of Germany

[21] Appl. No.: 856,981

[22] Filed: Dec. 2, 1977

[30] Foreign Application Priority Data

Dec. 15, 1976 [ZA] South Africa ..... 76/7474

[51] Int. Cl.[2] ..... E04H 3/20

[52] U.S. Cl. ..... 15/1.7

[58] Field of Search ..... 15/1.7; 114/222

[56] References Cited

U.S. PATENT DOCUMENTS

| | | | |
|---|---|---|---|
| 3,324,492 | 6/1967 | Myers | 15/1.7 |
| 3,886,616 | 6/1975 | Hayes | 15/1.7 |
| 3,906,572 | 9/1975 | Winn | 15/1.7 |
| 3,979,788 | 9/1976 | Strausak | 15/1.7 |

*Primary Examiner*—Edward L. Roberts

*Attorney, Agent, or Firm*—Cushman, Darby & Cushman

[57] ABSTRACT

An electrically driven endless track vehicle draws water through a filter compartment and expels the water normal to the surface on which the vehicle runs. An unbalanced float and random timing of a reversing switch causes the vehicle to traverse a pool floor randomly.

10 Claims, 3 Drawing Figures

POOL CLEANERS

BACKGROUND OF THE INVENTION

This invention relates to pool cleaners.

For the cleaning of swimming pools basically two types of cleaners are in use. The type which is most commonly used is operated by suction from the swimming pool pump. The cleaning head may be steered by an operator or it may be designed to move randomly over the pool bottom. The other type is a suction cleaner working from mains pressure and which collects dirt in its own filter bag. The latter has not yet been designed to work randomly without attention and the suction head has to be steered by an operator.

An object of the invention is to provide a cleaner independent of the pool filter and which can be arranged to operate randomly and unattended.

SUMMARY OF THE INVENTION

According to the invention a pool cleaner comprises:

a body;

wheels on the body;

an electrically driven motor for driving the wheels to propel the body along the floor of a pool;

a filter chamber in the interior of the body;

an inlet to the chamber on the base of the body;

an electrically driven pump for drawing water through the chamber;

a pump outlet from the body for expelling water in a direction normal to the base of the body; and a float pivoted to the body to extend above the body when the body is submerged in water.

In the preferred form of the invention the body is propelled by endless tracks. Also the invention provides that the sides not covered by the endless tracks be formed with brush drums, each drum carrying at least one brush.

DESCRIPTION OF A PREFERRED EMBODIMENT

Figure 1:
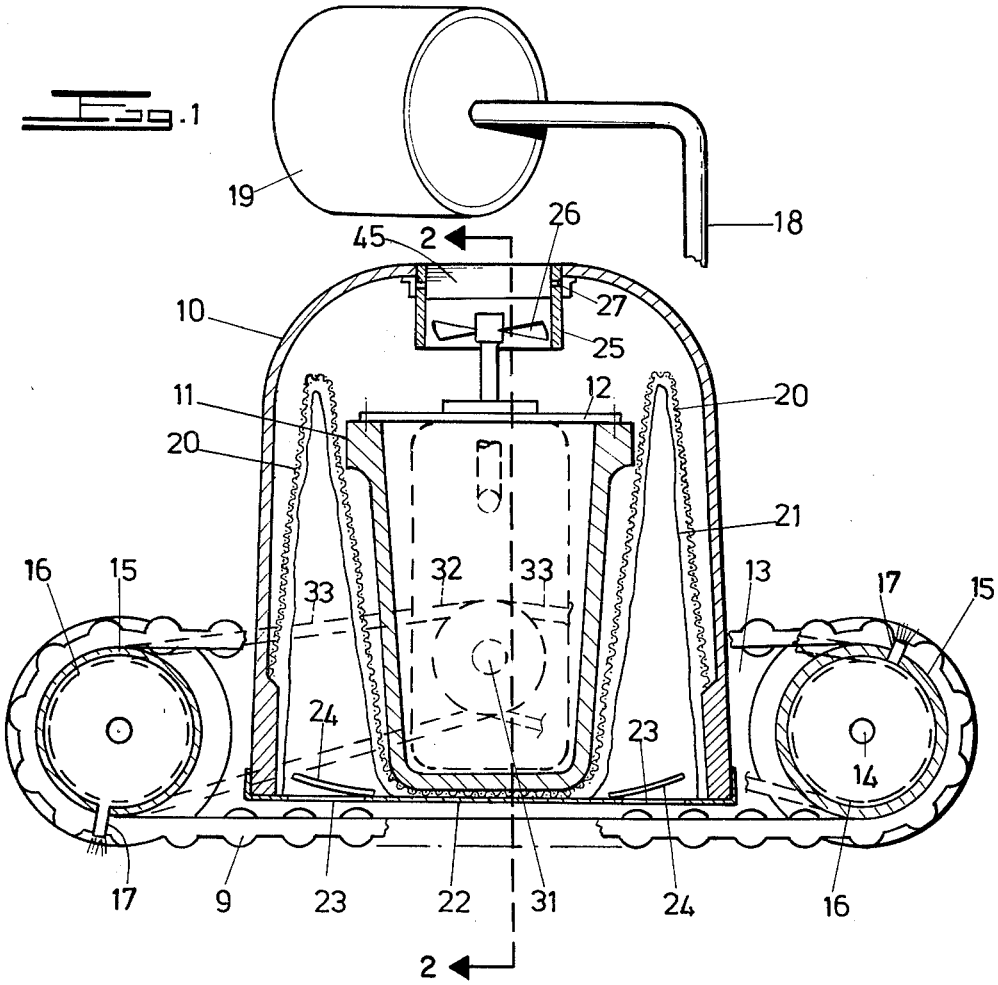
FIG. 1 is a section through a pool cleaner.
Figure 3:
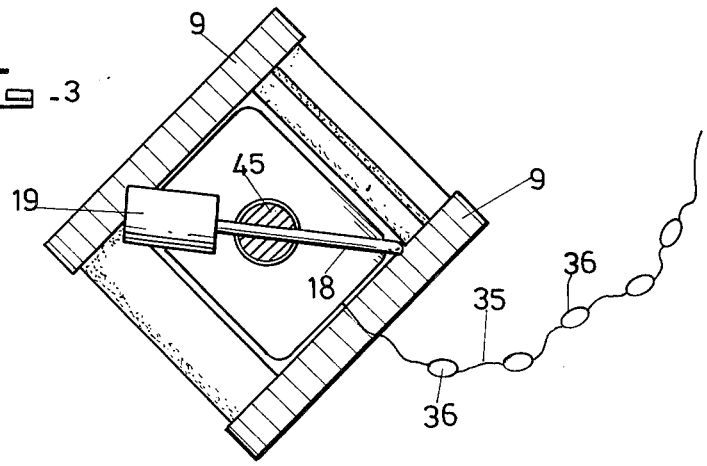
FIG. 3 is a plan view to a smaller scale of the same cleaner.

The illustrated cleaner has a main body 10 virtually formed as an inverted open-ended box with a hole at the top. Inside the body 10 there is a secondary body 11 extending from side to side and having a water tight lid 12. The body 11 houses the electrical components to be described later on.

At each end (FIG. 1) the body 11 is provided with flanges 13 in which are journalled axles 14. Secured to the axles 14 are firstly a pair of wheels 15 and secondly a drum 16 which on its surface is lined with foam plastics. At one position along its periphery each drum 16 carries a brush 17 which extends axially along the surface. Endless tracks 9 are driven by wheels 15 from opposed axles 14.

Pivoted to the body 10 is also a diagonal handle 18 which carries a float 19. As shown the float is to the one side of the handle and thus is unbalanced to an extent.

As can be seen in FIG. 1 there are two compartments beside the body 11. These compartments are occupied by a filter screen 20. The screen 20 is lined by a detachable filter bag 21. The screen 20 is held in place by means of a lid 22 which clips on to the underside of the body 10. The lid 22 has two apertures 23 covered by rubber flaps 24. Suction in the interior of the body 10 lifts the flaps 24 while pressure closes them. In place of the bag 21 the screen 20 may be lined with a layer of cotton wool about 3 mm thick sprayed on both sides with a lacquer. The lacquer consolidates the fibres and prevents them from being carried away. Alternatively the bag 21 may be lined with the cotton wool layer. In any case the layer is thrown away once it is clogged up.

The hole at the top of the body 10 is located a casing 25 for an axial flow pump impeller 26. The casing 25 has two small bleed holes 27 to allow for the escape of air from the body 10. At its mouth the casing 25 is formed with parallel guide vanes 45. In the absence of the vanes 45, the appliance tends to turn about the impeller axis.

The body 11 houses firstly an electrical motor 30 which drives a spindle 31 carrying a pulley 32 for driving one pair of wheels 15 by means of belts 33. Secondly it contains an electric motor 34 which drives the impeller 26. It should be noted that both of the motors 30 and 34 operate on low voltage electric current. A voltage of 24 V has proved to be satisfactory and safe. Power is fed to the appliance by means of a cord 35 over which have been threaded a series of floats 36.

Figure 2:
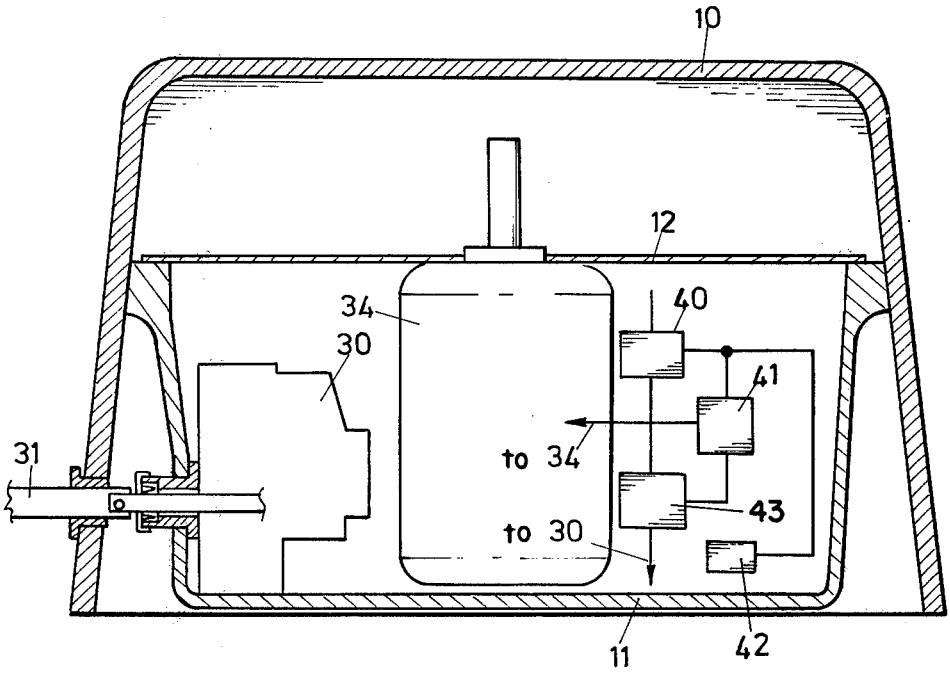
FIG. 2 is a view partly in cross-section and partly in elevation taken generally along the line 2—2 of FIG. 1, with portions removed for clarity.

Finally the body 11 contains certain control elements for the motor 30 which is reversible. With power on the motor 34 runs continuously, but when the appliance as a whole is switched off, the motor 30 is also switched off. The electrical control components are so small that they cannot easily be illustrated. Therefore, in FIG. 2 the components have been indicated in block form.

Current flows through a main switch 40 which is normally on but which may be switched off by two events. First there is a timer 41 which after a preset interval of time, say 6 hours, actuates the main switch 40. Thus if the appliance is forgotten by the user, it gets switched off after a time. Secondly there is a water detector 42 which generates a signal to actuate the main switch 40 as soon as it detects the presence of water in the body 11. The detector 42 is mounted on the floor of the body 11.

From the main switch 40 current flows directly to the motor 34. Current to the motor 30 passes through a reversing switch 43. The switch 43 reverses the direction of rotation of the motor 34 every time that it is actuated. Reversal takes place as a result of a signal which is randomly generated by the timer, 41. This random signal ensures that the appliance does not get stuck in a corner.

Due to the thrust exerted by the impeller 26 the appliance is capable of climbing up vertical walls. If it does so, it goes down again either as a result of the random reversal or it sucks in air and loses contact and slides down.

As said above, the float 19 is unbalanced, if the appliance comes down a wall this unbalanced condition will cause the appliance to veer off its former track and take a slightly different course.

With the random reversal and the unbalanced float, the appliance covers the floor of a pool in a random fashion, but after a sufficiently long period of time, it covers the entire pool floor.

After that period the current is switched off on surface, the appliance taken out of the water and the bag 21 removed and cleaned out. Depending on the state of the pool, the procedure is continued.

In a suitable case the current draft of the appliance could be used to indicate the state of the bag 21. If it is clogged up, the motor 30 will draw more current and that can be indicated on an ammeter or excess current draft could be used to actuate an alarm.

I claim:

1. A pool cleaner comprising:

a body;

four wheels on the body mounted on two shafts;

endless tracks joining pairs of wheels from opposed shafts;

an electrically driven motor for driving the wheels to propel the body along the floor of a pool;

a filter chamber in the interior of the body;

an inlet to the chamber on the base of the body;

an electrically driven pump for drawing water through the chamber;

a pump outlet from the body for expelling water in a direction normal to the base of the body; and a float pivoted to the body to extend above the body when the body is submerged in water for tending to keep the body upright in water and the float being unbalanced about the body to cause the body to move down in water at angle to the vertical.

2. The cleaner claimed in claim 1 in which the shafts are enclosed by drums each carrying a brush extending between the endless tracks.

3. The cleaner claimed in claim 2 in which the inlet is closed by a pivoted flap biased to prevent flow from the chamber.

4. The cleaner claimed in claim 3 in which the filter chamber comprises a screen wall attached to a detachable base to the body.

5. The cleaner claimed in claim 4 including a filter bag lining the screen wall.

6. The cleaner claimed in claim 5 in which the bag is lined with a layer of felted material spray painted on each side.

7. The cleaner claimed in claim 6 in which the pump is an axial flow pump.

8. The cleaner claimed in claim 7 including a sealed off hollow in the body housing the electrical components and a filter chamber to either side of the hollow and a space above the hollow and the filter chambers from which the axial pump draws water.

9. The cleaner claimed in claim 8 including a bleed hole from the space to the discharge of the pump.

10. The pool cleaner claimed in claim 1 in which the motor is reversible and including a reversing switch for the motor and a random signal generator for generating switching impulses to operate the reversing switch at random intervals.

* * * * *